United States Patent [19]

Guiraud

[11] 3,986,739

[45] Oct. 19, 1976

[54] RETRACTABLE SAFETY BOLT FOR DOOR LEAF

[76] Inventor: Francois Guiraud, Chemin des Alluets, 78240 Chambourcy, France

[22] Filed: Sept. 18, 1973

[21] Appl. No.: 398,401

[30] Foreign Application Priority Data

Sept. 18, 1972 France ..... 72.32965
Mar. 28, 1973 France ..... 73.11089

[52] U.S. Cl. ..... 292/37; 70/107
[51] Int. Cl.[2] ..... E05C 1/06
[58] Field of Search ..... 292/34, 37, 40; 70/107; 49/366

[56] References Cited

UNITED STATES PATENTS 3,660,940 5/1972 Tavano ..... 49/366
3,672,714 6/1972 Schultz ..... 292/34

*Primary Examiner*—Roy D. Frazier
*Assistant Examiner*—William E. Lyddane
*Attorney, Agent, or Firm*—Kenneth S. Goldfarb

[57] ABSTRACT

Device for controlling means of maintaining a door leaf in its casing, including, in addition to a conventional bolt, a section extending over the height of the outer edge of the leaf and introduced for the locked closure of the door into a matching groove in the casing, said section being disengageable by a horizontal translation movement for unlocking, wherein a handle, starting from the locked position, enables the flat section or safety bolt to be disengaged during a first rotation phase and the conventional or latch bolt to be retracted during a subsequent phase.

Said device also comprising a rotary disk that can be operated by handles for driving, on one hand, the bolt extending over the height of the door and, on the other hand, the latch bolt, under control of a main lock, together with a secondary lock suitable for driving the latch bolt, the latter being integral with a shoulder type plate, said disk being cut-out in such a way that, by cooperating with the shoulder of the plate, it enables the latch bolt to be directly actuated.

6 Claims, 16 Drawing Figures

43
46
54
66
67
102
94
91
92
72
71
73
101
77
76'
86
110
87
111

RETRACTABLE SAFETY BOLT FOR DOOR LEAF

The present invention relates to a device for operating means intended for maintaining a door in its closed position.

It applies to doors in which the closed position can be ensured not only by an ordinary bevel-headed bolt, sometimes known as a latch bolt, but also by the cooperation of a flat member extending over a major portion of the height of the door, advantageously the entire height, with a matching housing, it making possible to open the door after extracting said flat member that can be called a safety bolt from its housing.

The object of the device according to the invention is to ensure operation of the latch bolt and the safety bolt under the control of safety means, in order to better meet better practice requirements.

The device according to the invention in particular enables an actuation on the site different from that of usual conditions of use, giving the habitual user the certainty that no one before him has disposed of the safety means, not even a site supervisor.

The device according to the invention, which provides for actuation of the safety bolt to be under control of a safety lock, is characterised by the structure that a second safety lock, or secondary lock, is provided for controlling and/or actuating the latch bolt, and the transmission means between the secondary lock and the latch bolt being such that their operativeness depends on the condition of the main lock.

According to another feature of the invention, the mechanism actuating the safety bolt is rotatably mounted about a pin about which the actuating mechanism of the latch bolt is also rotatably mounted, and the movement transmission means being provided between the latter and the secondary lock under the control of the main lock.

The invention relates to an embodiment whereby said actuating means include handles by means of which it is also possible, under the control of the main lock, to retract the latch bolt.

It relates to a mode of execution characterised in that the same disk with a cut-out contour, integral with the handles, not only ensures that the safety bolt is secured, under the control of the safety lock, but also ensures direct drive of the latch bolt.

The invention also relates to means that ensure said disk has a predetermined position for cooperating with the mobile member of the safety lock that secures it.

In the following description, given by way of example, reference is made to the attached drawings, wherein.

Figure 1:
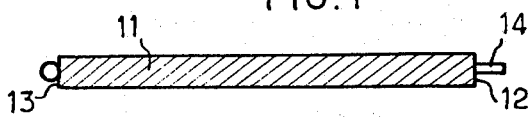
FIG. 1 is a very diagrammatic horizontal crosssection of a door.
Figure 16:
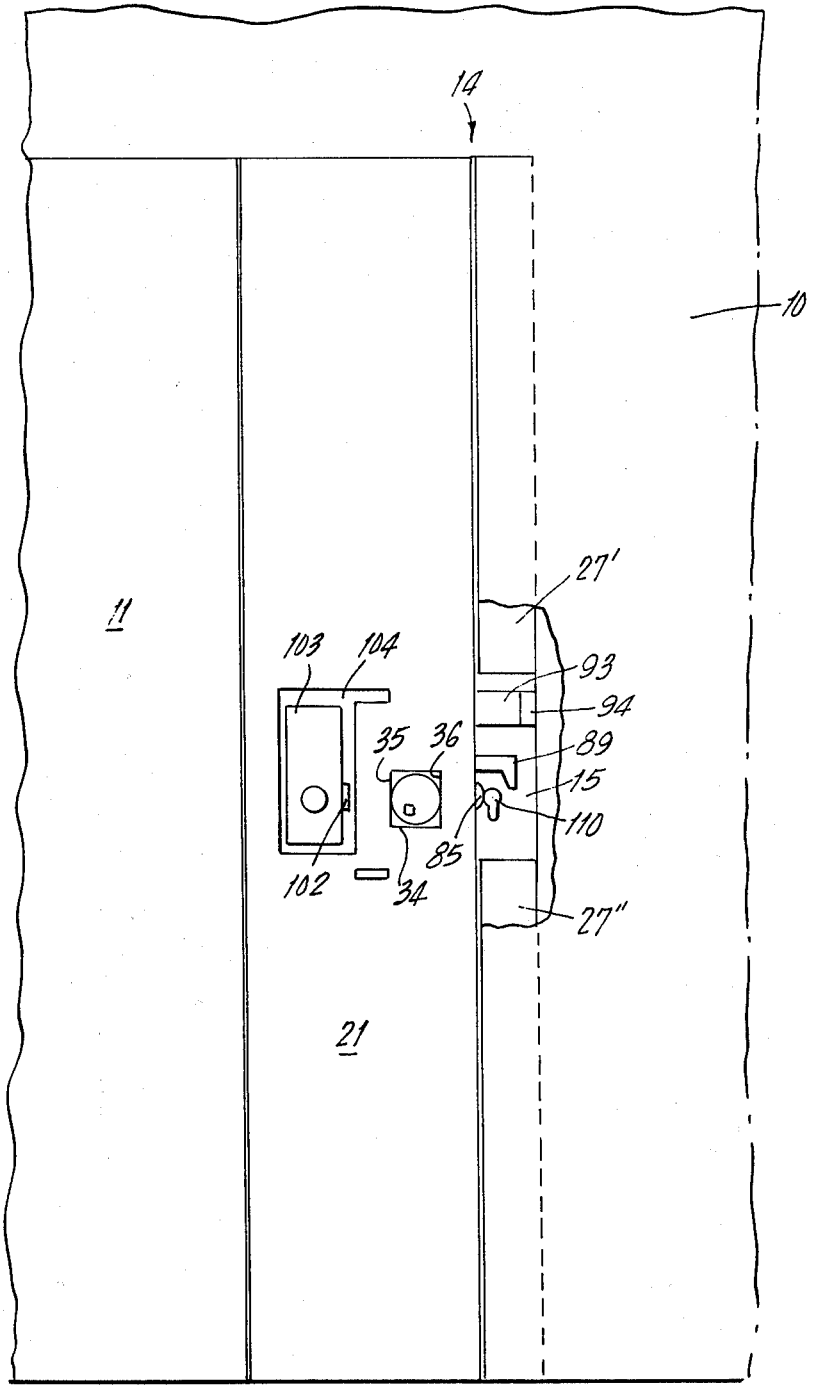
FIG. 16 is an elevation view similar to FIG. 2 shown partly broken away illustrating a door leaf having the safety bolt and latch bolt in projecting position.

The door leaf 11, (FIG. 1), is provided, — on its edge 12 opposite edge 13 by which leaf 11 is rotatably mounted on the door frame or casing 10 by means of hinges —, with a section 14 which generally extends over the entire height of the leaf as more clearly illustrated in FIG. 16, or the major portion thereof, means being provided, advantageously rollers, to enable the section to perform, in relation to leaf 11, a horizontal translation movement parallel to the medium plane of the leaf, so as to be able to pass from an open condition, wherein it does not project in relation to edge 12, to a closed or locked condition wherein it is engaged in an opposite housing or groove in the frame or casing of the door as illustrated in FIG. 16.

Figure 2:
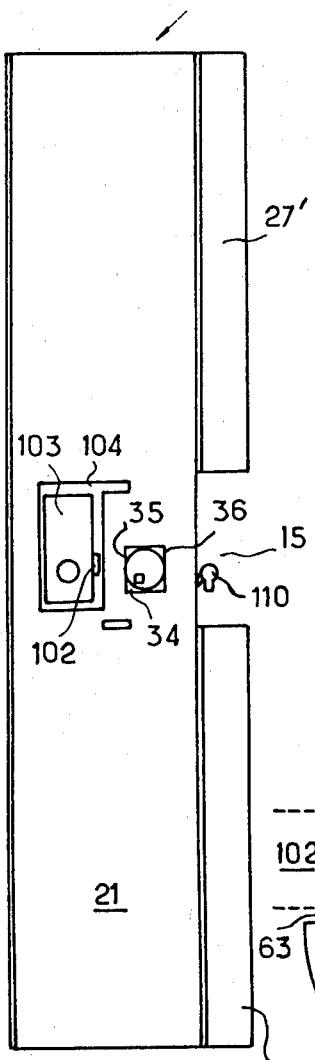
FIG. 2 is an elevation view of a flat locking member or safety bolt.
Figure 3:
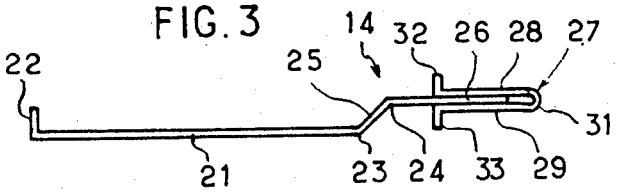
FIG. 3 is a large scale top view of said safety bolt.

Section 14, (FIG. 2), includes a flat body 21 whose inner side is a bracing edge 22 and which possesses two vertical folds 23 and 24, (FIG. 3), defining an oblique portion 25, together with an outer portion 26 parallel to flat body 21. The free edge of outer portion 26 is covered by a U shaped capping member 27 with two arms 28 and 29 surrounding portion 26 and interconnected by a curved portion 31, arms 28 and 29 ending in flanges 32 and 33. Section 14 is cut out to leave, in a mid-height zone, only flat body 21 to the exclusion of oblique portion 25 and portion 26, thus providing an interval 15 on either side of which are located portions 27' and 27'' of capping member 27.

Body 21 of section 14 possesses, substantially at the level of interval 15, a first rectangular orifice 104 to admit a safety lock 103 having a sliding securing member 102. Also substantially at the level of interval 15, body 21 possesses a second square orifice 34 with vertical edges 35 and 36 suitable for cooperating with the edge 37 of a circular disk or cam 38, (FIG. 4), having an orifice 39 with a square contour whose center 41 is remote from center 42 of disk 38.

Figure 5:
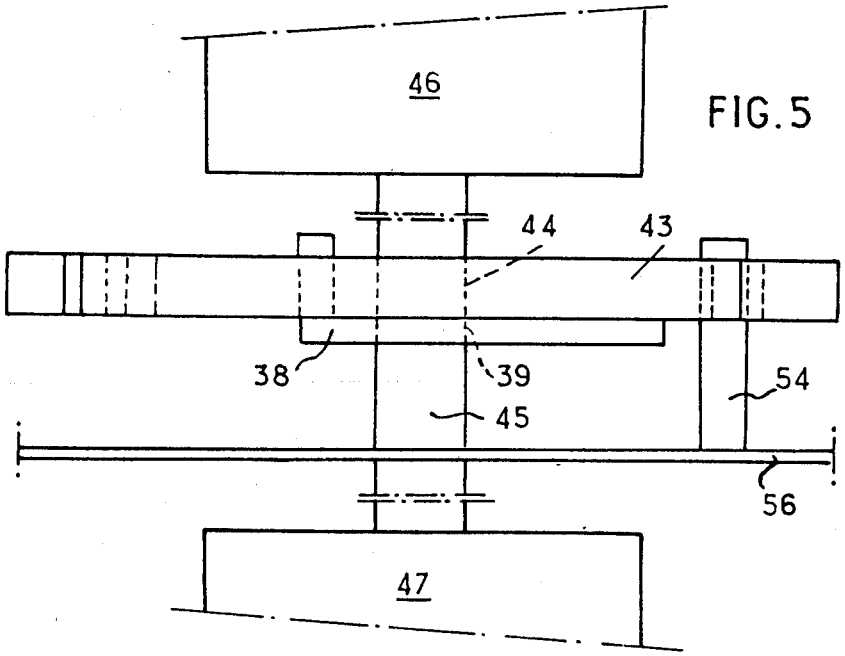
FIG. 5 is a corresponding top view of the discs in FIG. 4.

The disk-cam 38 is integral with a cut-out securing disk 43, (FIG. 5), which is applied thereto and which has a square contour orifice 44 extending orifice 39.

Orifices 39 and 44 serve to admit a rod 45 having a square cross-section whose contour matches said orifices and which enables both circular disk 38 and disk 43 to be rotated by actuating one or the other of inner handle 46 or outer handle 47. The rotation of the unit constituted by disk-cam 38 and securing disk 43 is limited by the abutment of radial sides 51 and 55 of disk 43 against a pin 54 integral with plate 56 forming part of the door body.

In addition to a circular portion 57 with center 41, included between sides 51 and 55, the edge 53 of disk 43 includes, on either side of said circular portion, circular portions 58 and 59 which have a larger radius. Portion 58, adjacent to side 51 is extended by a rectilinear portion 61 forming an obtuse angle with the extremity of portion 58 which is connected to a circular portion 62 by a substantially radial rectilinear side or edge 63. Between circular portions 59 and 62, edge 53 of disk 43 possesses a rectilinear portion 64 inset in relation to the extensions of circular portions 59 and 62, connected to portion 62 by a side 65 forming with said portion 62 an acute angle thus defining a beak member 66 and to circular portion 59 by a substantially radial rectilinear side 67. Sides 64, 66 and 67 thus define a cut-out whose contour matches that of the extremity of sliding member 102 of safety lock 33.

Figure 6:
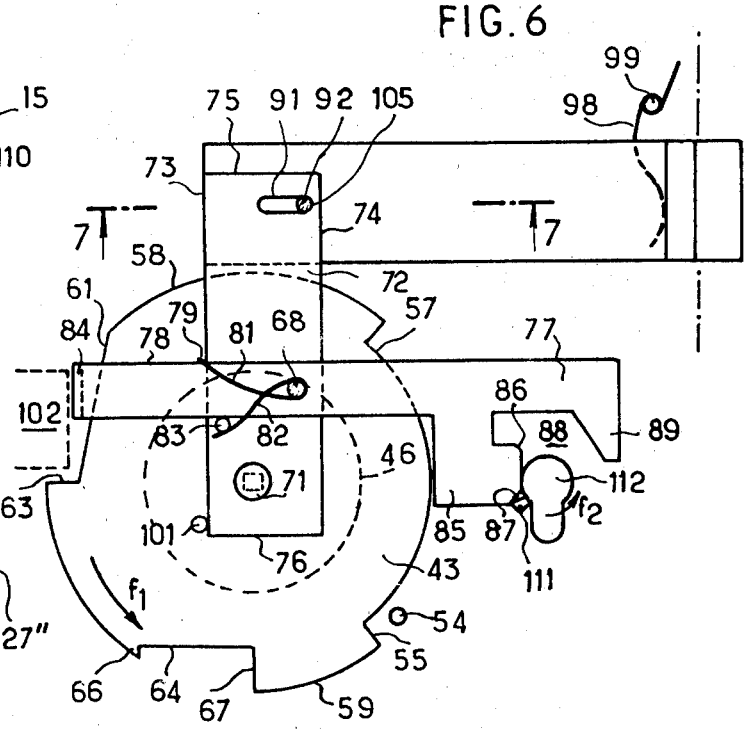
FIG. 6 is an elevation diagram of the operating and control device.

A plate 72 with a rectangular contour defined by two long vertical sides 73 and 74 and two small sides 75 and 76 is rotatably mounted on a circular surface 71, (FIG. 6), coaxial with the square cross-section portion of rod 45. In a mid-height zone, plate 72 has a pin 68 which is perpendicular thereto and upon which is rotatably mounted a swing lever 77 by means of its matching hole. Swing lever 77, which is generally horizontally orientated, has an upper edge 78 biased by the curved extremity 79 of a wire of spring 81 wound around pin 68 and whose other extremity 82 bears against a stud 83 on plate 72. Spring 81 thus tends to rotate swing lever 77 in relation to plate 72 anti-clockwise about stud 68 of said plate. The inner extremity of swing lever 77 is constituted by a folded member 84 which, in the position represented in FIG. 6, is adjacent to the rectilinear portion 61 of cut-out disk 43.

Inwardly of its outer extremity, swing lever 77 has a generally L-shaped appendix 85 whose outer edge comprises an upper flattened portion 86 and a lower flattened portion 87. A cut-out portion 88 of swing lever 77 is bordered on one hand by appendix 85 and, on the other hand, by an end beak 89.

Figure 7:
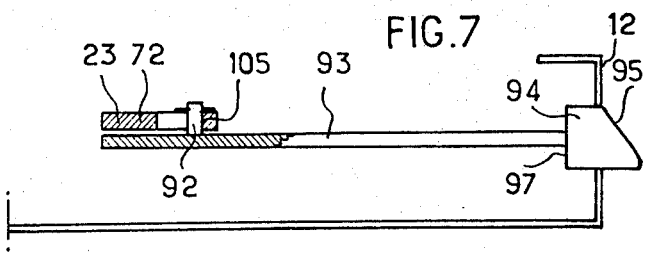
FIG. 7 is a cross-section along line 7—7 of FIG. 6.

Adjacent to its upper edge 75, plate 72 has a horizontal slot 91 in which engages a stud 92 on a flat body 93, (FIG. 7) of a bolt mounted for horizontal sliding whose outer extremity is constituted by a bolt head 94 with a bevel face 95 which can project in relation to edge 12 of door leaf 11. A leaf spring 98, whose other extremity is wound about a fixed pin 99, biases inner face 97 of bolt head 94.

A second safety lock 110, or secondary lock, operated by a key and whose actuation displaces a finger 111 or bit in a rotation movement about axis 112 of lock 110 passes through the door leaf at right angles to interval 15. According to the rotation direction imparted to bit 111 by operation of lock 112 key, said bit cooperates either with flatted portion 87, or with the flatted portion 86 of swing lever 77.

Figure 4:
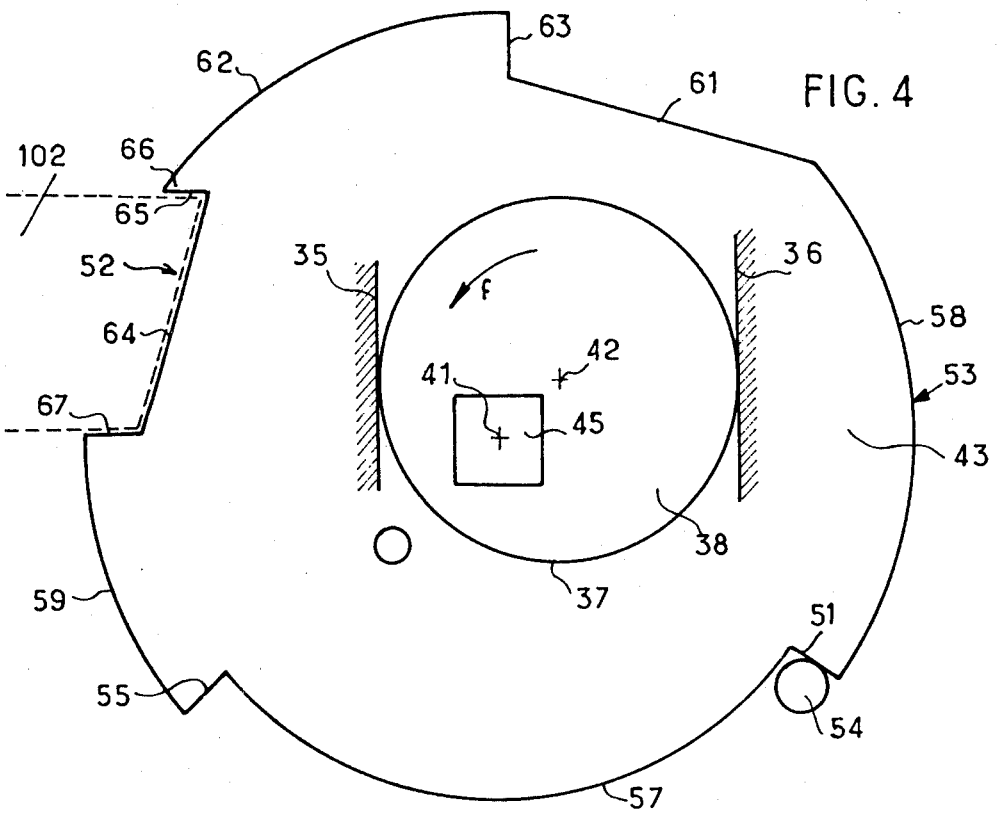
FIG. 4 is a frontal diagram of two actuating disks.

The position represented in FIG. 4 is that corresponding to the projecting position of section 14 and the engagement of sliding member 102 of the main safety lock 103 and groove 52, which is the closed position. The rotation of the unit constituted by disk 43 and disk 38 is not possible owing to the engagement of sliding member 102 in groove 52. When the door is locked in closed position, the engagement of flat section 14 extending over the entire height of the door in the groove provided in the latter's casing makes it burglar proof. The end projecting position of section 14 is determined by the abutment of side 51 against pin 54.

Member 102 is retracted by actuating safety lock 103 which then releases disk 43. It is then possible to rotate the unit constituted by the two disks 43 and 38 by means of a handle, 46 or 47. By the cooperation of edge 37 of disk 38, which rotates in the direction of arrow *f*, (FIG. 4), with edge 35, section 14 is progressively retracted until it no longer projects in relation to edge 12 and no longer prevents the door from being open. In this position of the mechanism, as represented in FIG. 6, the leaf of the door is still maintained by the engagement of bolt 94 in the matching housing of the casing. Side 55 of cut-out disk 43 is adjacent to pin 54, but still distant therefrom. By continuing to actuate a handle 46 or 47, in the direction indicated by arrow $f_1$, a stud 101 carried by disk 43 cooperates with the lower extremity of side 73 of plate 72 and tends to rotate it about surface 71.

Figures 8, 9, 10, 11:
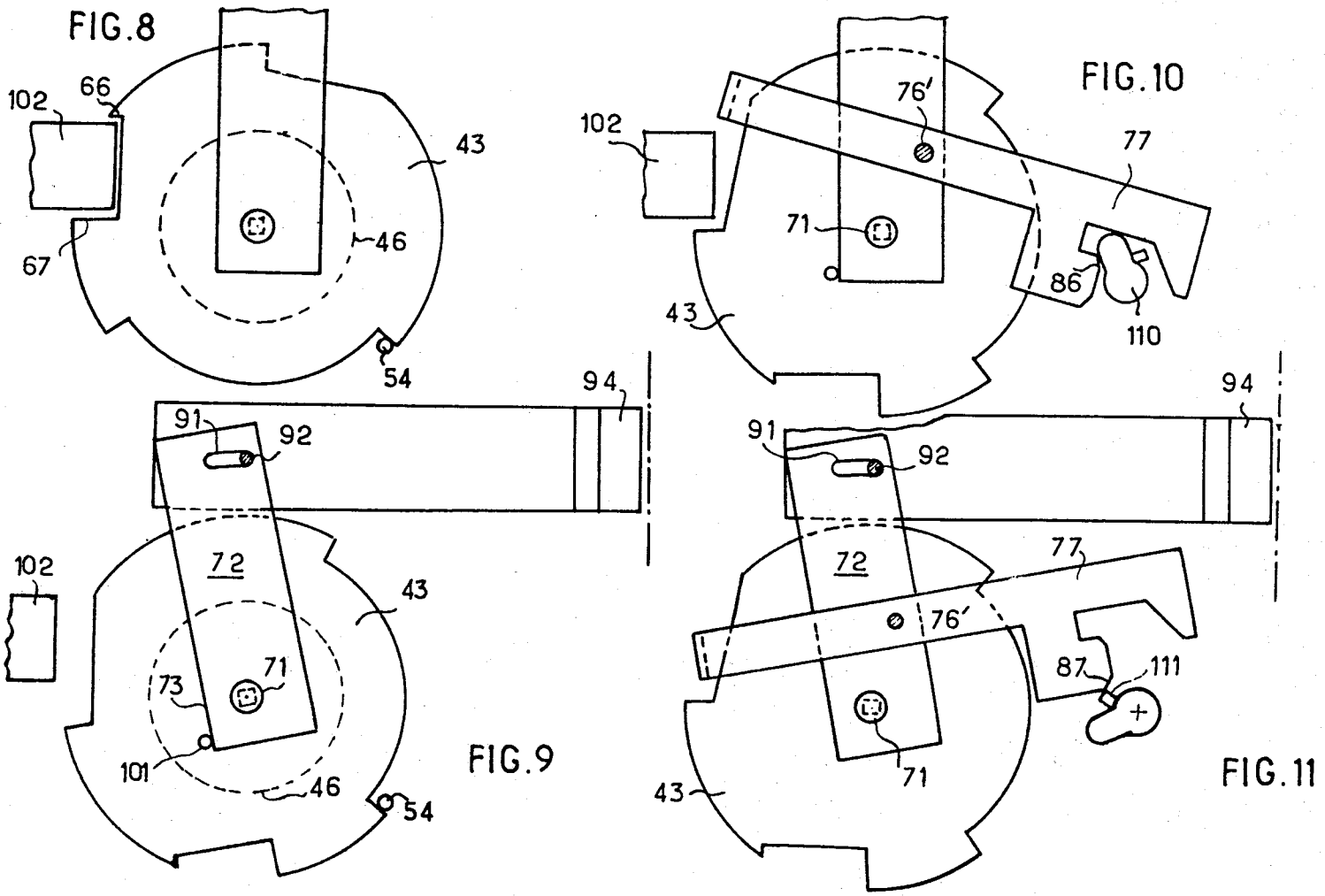
FIG. 8 is a view analogous to FIG. 6.
FIG. 9 is a view analogous to FIG. 6, but in another condition and with certain members omitted.
FIG. 10 is a view analogous to FIG. 9, but for another condition.
FIG. 11 is a view analogous to FIGS. 9 and 10, but for yet another condition.

During this rotation, swing lever 77 carried by pin 68 of plate 72 tends to move from right to left. A sliding member 102 of key type safety lock bolt 103 is then in retracted position, the cooperation of lug 101 of disk 43 with the lower extremity of side 73 of plate 72 then causes the latter to rotate about surface 71. The end 105 of slot 91 cooperates with pin 92, and bolt 93 is displaced from right to left against the bias of spring 98; bolt head 94 assumes its retracted position, which enables the door to be opened, (FIG.9). The retraction movement of bolt 94 is limited by abutment of side 55 against pin 54.

In the open state of the main lock 103, consequently, rotation of the handle enables section 14 carried by the door leaf to be disengaged from the groove in the casing, in a first stage, and enables the usual bolt to be retracted in a second phase, hence allowing the door to open.

When the leaf is again in closed position, operation in the reverse direction of handle 46 or handle 47 returns section 14 to projecting position, by the cooperation of edge 37 of disk 38 with side 36 of cut-out portion 34; the outer edge of section 14 constituted by capping member 27 sheathing the portion 26 then penetrates the housing or groove of the casing opposite it when the leaf is in its close position, thus locking the door in this position.

If, on the other hand, after being extracted from groove or slot 52 to enable section 14 to be retracted, mobile member 102 of bolt 103 has, after retraction of the section, been returned to its projecting position, the right to left movement of spring lever 77 is arrested by abutment of edge 84 with sliding member 102, which is then its projecting position, so that rotation in the direction of arrow $f_1$ of cut-out disk 43 cannot continue, pin 101 encountering the vertical edge 73 of plate 72 which cannot move owing to abutment of edge 84 of the spring lever that it carries. Hence, the door cannot be opened by rotating handle 45 or 46. The possessor of the key to lock 103 has thus been able to retract section 104 and, then, after returning main lock 103 to its close position by means of the key, has been able to prevent the door from opening simply by immobilizing latch bolt 94.

Starting from the position represented in FIG. 6, wherein release of the door leaf is impossible simply by continuing to rotate handles 45 and 46 in the direction of arrow $f_1$, prior actuation of secondary lock 110 by rotating bit 111 in the direction of — arrow $f_2$ using the key, causes said bit to cooperate with flattened portion 86 (FIG. 10); spring lever 77 pivots clockwise about pin 68; edge 84 is separated from sliding member 102 of main lock 103; disk 43 can then continue to be rotated in the direction of arrow $f_1$ by actuating one of handle 45 or 46; plate 72 can then pivot, spring lever 77 carried by said plate then following with its extremity adjacent to edge 94 a path that does not encounter member 102; pivoting of plate 72 about pin 71 displaces bolt head 94 from right to left and the door can open, although bolt 103 is in its closed position, but only after previously actuating secondary lock 110.

During construction the device is delivered without safety lock 103, which is only subsequently handed over to the owner or tenant. In the door leaf, section 14 is in retracted position and hence disk 43 is in the position represented in FIG. 6, means being provided to lock it in this position. As disk 43 is prevented from rotating, it is impossible to retract bolt head 94 by rotating a handle 46 or 47. But, it is possible to open the door by means of lock 110. By rotating bit 111 clockwise from the position represented in FIG. 6, but in the absence of sliding member 102, since lock 103 has not been fitted, the unit constituted by swing lever 77 and plate 72 rotates about surface 71 anticlockwise and bolt head 94 is retracted, (FIG. 11).

Figure 12:
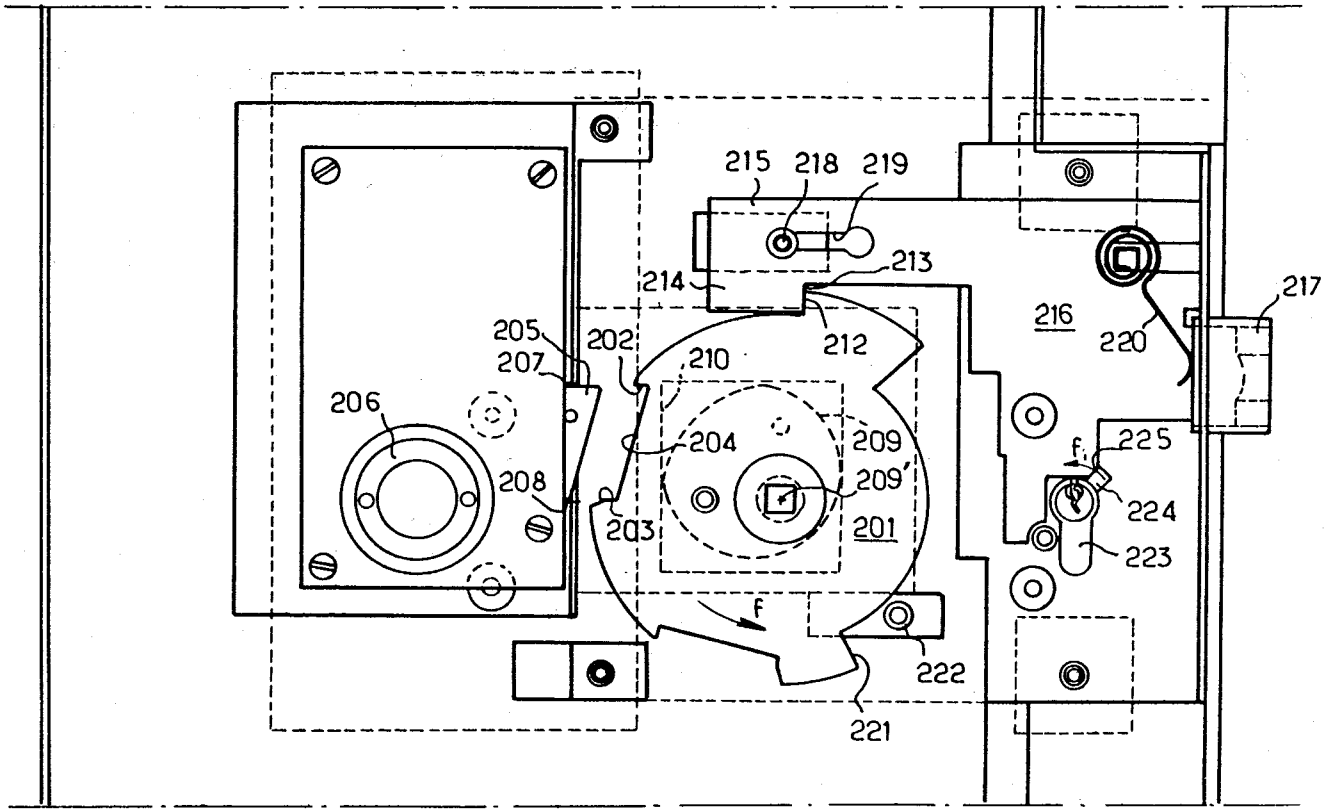
FIG. 12 is a frontal view of another embodiment of the device according to the invention.

In the embodiment represented in FIG. 12, the securing disk 201 is in the position wherein it is suitable, by means of sides 202 and 203 of its slots 204, for cooperating with mobile member 205 of the safety lock 206. In the position represented in said figure, member 205 is in retracted position. But in projecting position, the upper edge 207 of member 201 is suitable for cooperating with side 202, and lower edge 208 of said member is suitable for cooperating with side 203, thus securing disk 201 to prevent it from rotating in either direction.

In said position, a cam track 209, which is integral with disk 201, but which projects laterally in relation thereto, has, during its rotation about pin 209, by cooperating with edge 210 of an opening provided on the safety lock, brought the latter into the retracted position wherein it is disengaged from the groove provided in the door casing, and thus does not cooperate with the latter.

In the position represented in FIG. 12, continued rotation of the handles with which disk 201 is integral, in the direction of arrow *f*, which is the anticlockwise direction, causes a stop edge 212 on said disk 201 to cooperate with edge 213 of a projection 214 comprised by the shank 215 of a plate 216 bearing latch bolt 217. The movement is guided by the cooperation of a pin 218 with a slot 219 in shank 215. This takes place against the bias of the spring 220. The movement is limited by the abutment of a substantially radial face 221 of disk 201 against a pin 222.

When member 205 is engaged in slot 204, it is impossible to open the latch bolt by rotating the handles with which disk 201 is integral, side 202 of said disk abutting against the upper edge 207 of member 205.

However, in this position, it is still possible to open the latch bolt by actuating a secondary lock 223, whose key is, for example, at the disposal of the personnel. By means of this lock, it is possible to rotate pin 224 integral with the mobile member of said lock and which cooperates with a flatted portion 225 of plate 216 carrying latch bolt 217 in the direction of arrow $f_1$. Said bolt is thus directly retracted, despite the locked condition of disk 201.

This is also the way in which the door is opened and closed before the safety lock is fitted, as required on the site.

Figure 13:
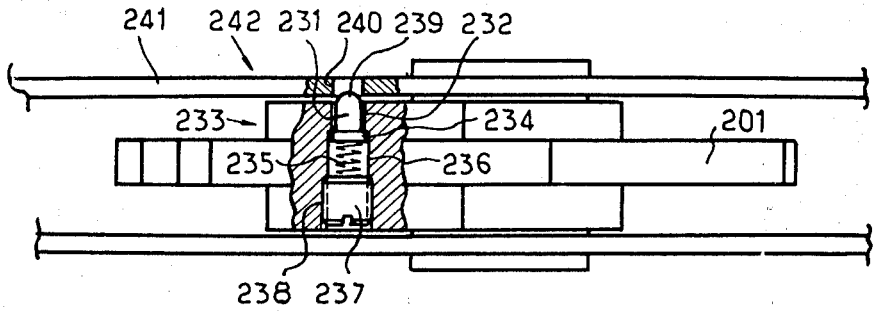
FIG. 13 is a horizontal cross-section of a door at the level of the device represented in FIG. 12.

The means for ensuring position of disk 201 represented in FIG. 12 includes (FIG. 13) a pin 231 housed in a channel 232 passing through part 233 on which disk 201 is formed. Said pin has an enlarged head 234 which is biased by a spring 235 housed in a widened portion 236 of channel 232 and bearing, on the other hand, against a screw 237 cooperating with the tapped portion 238 of channel 236.

The rounded extremity 239 of pin 231 cooperates for positioning with a hole 240 provided on a plate 241 constituting door leaf 242.

Figure 14:
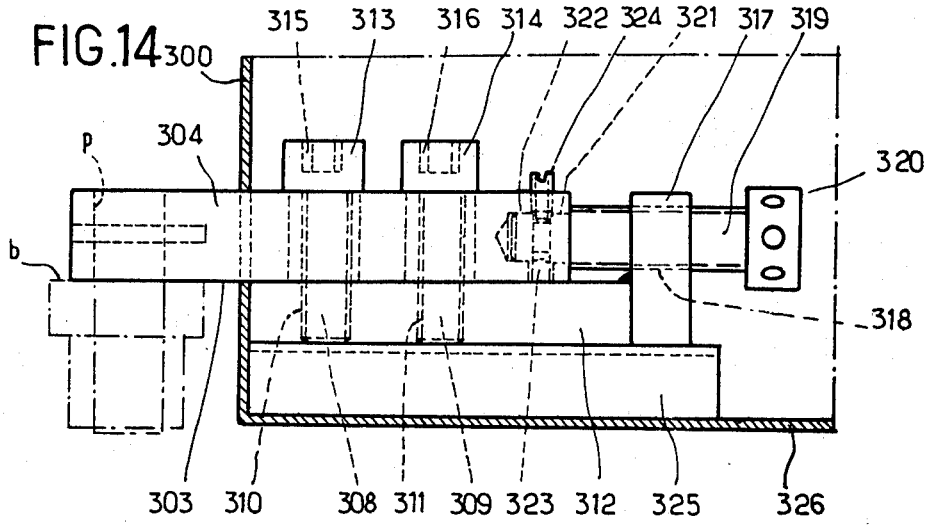
FIG. 14 is a partial cross-section elevation of a leaf rotational support.
Figure 15:
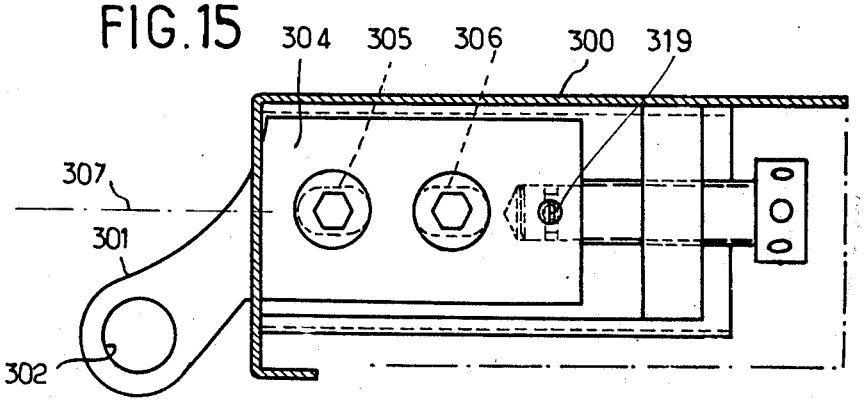
FIG. 15 is a corresponding top view.

Reference is now made to FIGS. 14 and 15 relating to a device for rotatably mounting a door leaf on a casing.

Lug 301, which has a circular orifice 302 suitable for fitting upon a door rotation mounting pivot *p*, and which includes a base *b* on which rests the lower face 303 of said lug, is integral with a block 304 which is mounted so as to be adjustable or adjusted both vertically and horizontally in relation to door casing 300.

For this purpose, lock 304 has oblong bore holes 305 and 306 whose large sides are orientated parallel to the mean vertical plane 307 of the casing and it is crossed by threaded rods 308 and 309 which cooperate with the tapped portions 310 and 311 of a base plate 312. The heads 313 and 314 integral with rods 308 and 309 possess polygonal cavities 315 and 316 for rotation.

An upright 317 is integral with base plate 312 and comprises a horizontal tapped hole 318 which cooperates with a threaded rod 319 having a head 320 comprising ten holes to enable adjustment and whose smaller diameter extremity 321 penetrates a hole 322 with a matching diameter in block 304. A locking screw 324 cooperates with a channel 223 in portion 321.

Base plate 321 is welded to a base 325 integral with the bottom 326.

In this way, it is possible to adjust the position of the leaf both vertically and horizontally in relation to casing *b*.

I claim:

1. A door leaf adapted to be rotatably mounted on a door frame or casing by means of hinges to provide a hinged vertical edge and a free vertical edge, said door leaf having a safety bolt section extending at least substantially over the entire height of the free vertical edge of said leaf, said safety bolt section being capable of a horizontal translation movement parallel to the plane of said door leaf, said safety bolt section having an inner vertical section and an outer vertical section, said outer vertical section having a cut out portion in a mid height zone thereof, said safety bolt comprising:

an orifice in said inner vertical section for receiving first locking means having a sliding securing member movable to projecting and retracting positions upon actuation of said first locking means;

rotatable securing disc means having a first peripheral portion comprising a recess defined by a radial side and a beak portion on opposed sides of said recess, said recess being positioned to receive said sliding securing member whereby to prevent rotation of said securing disc means when said safety bolt is in a projected position, said securing disc means being mounted by means of a centrally located orifice on rotatable axle means of rectilinear cross section and extending transversely through said inner vertical section, said securing disc means having a projecting protion for actuating a latch bolt;

rotatable cam disc means integral with said rotatable securing disc means, said cam disc means being positioned in a rectilinear orifice provided in said inner vertical section and mounted on said rotatable axle means by means of a non-centrally located orifice;

handle means accessible to the user mounted on opposed end portions of said rotatable axle means, second locking means in said cut out portion having a rotatable member capable of clockwise and counter clockwise rotation;

latch bolt means integral with flat body plate means, connecting plate means linking said flat body plate means with said rotatable axle means, said connecting plate means comprising a plate of generally rectangular configuration having vertical and horizontal sides rotatably mounted on a circular surface provided on said rotatable axle means, rotation of said plate being independent of the rotation of said axle means, pin means on said plate, a generally horizontally orientated swing lever rotatably mounted on said pin means having an inner portion terminating in a vertical edge and an outer portion, the outer portion being in contact with the rotatable member of said second lock means, said lever being attached to said connecting plate means, said connecting plate means upon actuation of said rotatable axle means causing said latch bolt means to move to open or closed position;

and wherein when unlocking said door leaf the peripheral surface of said cam disc means, during a first rotation phase of said handle means cooperates with said rectilinear orifice causing said safety bolt to retract and wherein said projecting portion of said securing disc means during a second rotation phase of said handle means contacts said connecting plate means causing said latch bolt to move to open position.

2. A door leaf according to claim 1 wherein said projecting portion comprises a lug positioned so as to come into contact with the inner vertical surface of said plate during said second rotation phase of said handle means.

3. A door leaf according to claim 1 wherein said latch bolt is spring-biased against retraction to open position.

4. A door leaf according to claim 1 wherein said rotatable securing disc means has a second peripheral portion comprising a recess defined by radial sides on opposed sides of said recess, said recess in combination with pin means integral with the door body providing means for limiting rotation of said rotatable securing disc means.

5. A door leaf according to claim 1 wherein said vertical edge of said swing lever is positioned adjacent said first peripheral portion when said door leaf is in retracted position.

6. A door leaf adapted to be rotatably mounted on a door frame or casing by means of hinges to provide a hinged vertical edge and a free vertical edge, said door leaf having a safety bolt section extending at least substantially over the entire height of the free vertical edge of said leaf, said safety bolt section being capable of a horizontal translation movement parallel to the plane of said door leaf, said safety bolt section having an inner vertical section and an outer vertical section, said outer vertical section having a cut out portion in a mid height zone thereof, said safety bolt comprising:

an orifice in said inner vertical section for receiving first locking means having a sliding securing member movable to projecting and retracting positions upon actuation of said first locking means;

rotatable securing disc means having a first peripheral portion comprising a recess defined by a radial side and a beak portion on opposed sides of said recess, aid recess being positioned to receive said sliding securing member whereby to prevent rotation of said securing disc means when said safety bolt is in a projected position, said securing disc means being mounted by means of a centrally located orifice on rotatable axle means of rectilinear cross section and extending transversely through said inner vertical section, said securing disc means having a projecting portion for actuating a latch bolt;

rotatable cam disc means integral with said rotatable securing disc means, said cam disc means being positioned in a rectilinear orifice provided in said inner vertical section and mounted on said rotatable axle means by means of non-centrally located orifice;

handle means accessible to the user mounted on opposed and portions of said rotatable axle means, second locking means in said cut out portion having a rotatable member capable of clockwise and counterclockwise rotation;

latch bolt means integral with flat body plate means, and wherein when unlocking said door leaf, the peripheral surface of said cam disc means, during a first rotation phase of said handle means cooperates with said rectilinear orifice causing said safety bolt to retract, and wherein said projecting portion of said securing cam disc means during a second rotation phase of said handle means contacts said flat body plate means causing said latch bolt to move to open position.

* * * * *